US008601732B2

(12) United States Patent
Kolton et al.

(10) Patent No.: US 8,601,732 B2
(45) **Date of Patent: *Dec. 10, 2013**

(54) SHRINK WRAP EYEGLASSES TAG WITH HOOK

(75) Inventors: Chester Kolton, Westfield, NJ (US); Michael Norman, East Brunswick, NJ (US); Jake Strassburger, South Plainfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 29 days.

This patent is subject to a terminal disclaimer.

(21) Appl. No.: 13/170,811

(22) Filed: Jun. 28, 2011

(65) Prior Publication Data

US 2012/0017479 A1 Jan. 26, 2012

Related U.S. Application Data

(60) Provisional application No. 61/359,624, filed on Jun. 29, 2010.

(51) Int. Cl.
*G09F 3/08* (2006.01)

(52) U.S. Cl.
USPC ..... 40/662

(58) Field of Classification Search
USPC ..... 40/662, 316; 211/85.1
See application file for complete search history.

(56) References Cited

U.S. PATENT DOCUMENTS

| | | | | | |
|---|---|---|---|---|---|
| 5,537,765 | A * | 7/1996 | Liebman et al. | ..... | 40/673 |
| 5,988,462 | A * | 11/1999 | Kolton | ..... | 223/85 |
| 6,145,167 | A * | 11/2000 | Brentini | ..... | 24/3.1 |
| 6,317,046 | B1 * | 11/2001 | Fresnel et al. | ..... | 340/572.9 |
| 6,330,758 | B1 | 12/2001 | Feibelman | | |
| 6,518,888 | B1 | 2/2003 | Kolton et al. | | |
| 7,804,408 | B2 | 9/2010 | Kolton et al. | | |
| 2007/0273535 | A1 * | 11/2007 | Kolton et al. | ..... | 340/572.8 |
| 2008/0272917 | A1 * | 11/2008 | Feibelman et al. | ..... | 340/572.9 |

* cited by examiner

*Primary Examiner* — Kristina Junge
(74) *Attorney, Agent, or Firm* — Hoffmann & Baron, LLP

(57) ABSTRACT

A tag assembly for securing a tag to a pair of eyeglasses that has a frame for holding a pair of lenses and first and second hinged legs. The tag assembly includes a tag, a label, a pad and a shrink tube. The tag includes a body that can have a hook extending from one end and a pair of slotted members extending from the front surface. The label has opposing side edges that are inserted into the slotted members. The pad has an adhesive side that secures the pad to the rear surface of the body and a friction side. The tag assembly is inserted in the shrink tube and receives one of the hinged legs of the pair of eyeglasses between the friction side of the pad and the shrink tube. The shrink tube secures the hinged leg in the tag assembly upon the application of heat.

20 Claims, 6 Drawing Sheets

SHRINK WRAP EYEGLASSES TAG WITH HOOK

This application claims priority from provisional application Ser. No. 61/359,624, filed on Jun. 29, 2010, which is incorporated herein in its entirety.

FIELD OF THE INVENTION

The present invention relates to tags that are used in the packaging and display of merchandise. In particular, the present invention relates to tags that are secured to eyeglasses and hung from merchandise displays.

BACKGROUND OF INVENTION

Small articles are commonly displayed for sale in retail stores on racks or in display cases where the articles are hung. A variety of different devices and tags have been used that are secured to the article and have a means for attachment to the rack or display. The design criteria for these tags include low manufacturing costs and easy and efficient attachment of the tags to the articles. The tags must also be convenient for the merchant to display and they must be convenient for the customer to remove after purchase.

Tags used for displaying eyeglasses must be designed so that the customer can easily view the eyeglasses and remove them from the display rack. The tags must also be designed so that the customer can easily try on the eyeglasses without having to remove the tag. Because a customer may try on several pairs of eyeglasses before making a selection, the tags must be designed so that they can be removed from the display and then put back in place by the customer numerous times without damaging either the eyeglasses or the tags.

Accordingly, there is a need for a tag for displaying eyeglasses that can be easily removed and reinstalled in the display and that does not prevent the eyeglasses from being worn by a customer. There is also a need for a tag for displaying eyeglasses that can be economically manufactured and easily and firmly secured to the eyeglasses.

SUMMARY OF THE INVENTION

In accordance with the present invention, a tag assembly for securing a tag to a pair of eyeglasses is provided. These eyeglasses typically have a frame for holding a pair of lenses and first and second hinged legs. The tag assembly includes a tag, a planar label, a substantially flat pad and a shrink tube. The tag includes a body, a pair of slotted members and optionally a hook. The body is substantially flat and has a first end, a second end, a front surface and a rear surface. The hook extends from the first end of the body or the tag can have a neck connecting the hook to the body. The tag is preferably formed from a hard plastic or nylon material. The planar label has opposing side edges and can contain indicia or other information, such as a bar code. The slotted members extend from the front surface of the body and are adapted to receive the opposing side edges of the label and secure the label to the body.

The substantially flat pad has an adhesive side and a friction side. The adhesive side of the pad is adapted to secure the pad to the rear surface of the body and the friction side is formed from a material having a high coefficient of friction, such as a soft rubber material, and is adapted to frictionally secure one of the hinged legs of the eyeglasses in the tag assembly.

The shrink tube has a side wall, a first end, a second end and an opening extending therebetween. The shrink tube is formed from a plastic material, for example polypropylene, polyvinyl chloride (PVC) or polyethylene, and shrinks when heat is applied. Preferably, the shrink tube is made from a plastic material that is transparent and biaxially oriented. The amount of heat required to shrink the shrink tube depends on the type of plastic that is used to construct the shrink tube. The criteria for selecting the plastic material and the amount of heat required to shrink the plastic are well known to those of ordinary skill in the art of packaging using heat shrinkable plastic materials. In one embodiment, the label can be affixed to the outside of the shrink tube using a glue or adhesive, such as a pressure-sensitive glue.

The tag assembly can be attached to the eyeglasses by first inserting the label into the pair of slotted members of the body. The adhesive side of the pad is then placed in contact with the rear surface of the body and the body of the tag is inserted into the shrink tube. One of the hinged legs of the pair of eyeglasses is then inserted into the shrink tube between the friction side of the pad and the side wall of the shrink tube. Heating the shrink tube secures the label and the hinged leg in the tag assembly. In another embodiment, the label is secured to the outside of the shrink tube with, for example, a pressure-sensitive glue.

BRIEF DESCRIPTION OF THE FIGURES

The preferred embodiments of the shrink-wrap eyeglasses tag with hook of the present invention, as well as other objects, features and advantages of this invention, will be apparent from the accompanying drawings wherein.

DETAILED DESCRIPTION OF THE INVENTION

Figure 1:
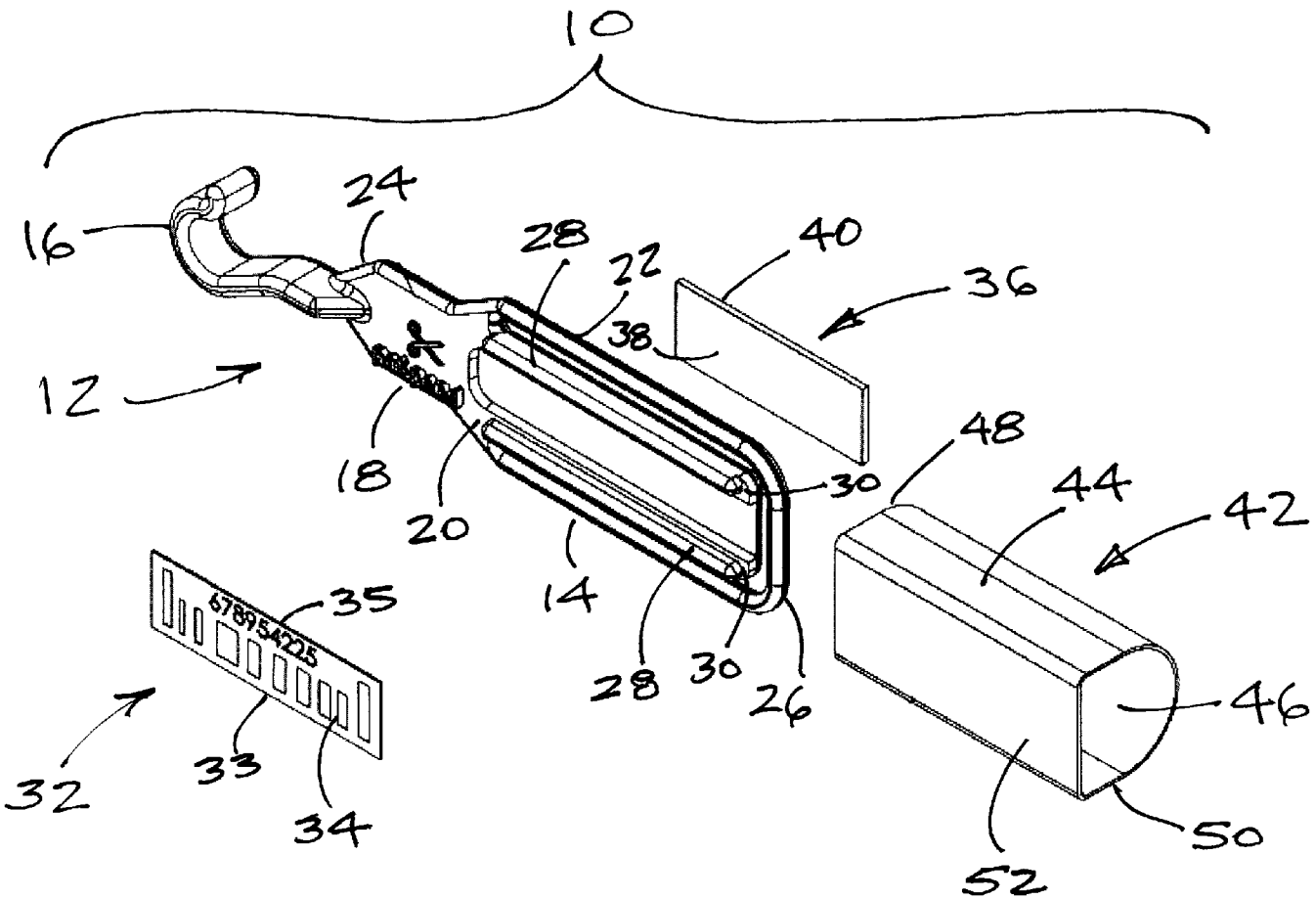
FIG. 1 is an exploded view of an embodiment of the shrink-wrap eyeglasses tag of the present invention.

The present invention is a tag assembly that includes a shrink-wrap eyeglasses tag with a hook. The tag assembly is used for securing a tag to a pair of eyeglasses having a frame and two hinged legs. The tag assembly includes a tag, a planar label, a substantially flat pad and a shrink tube. The tag includes a body having a first end, a second end, a front surface and a rear surface. The tag may or may not include a hook extending from the first end of the body. The hook may be used for attaching the tag to a structure, such as a rack or a support member in a display. The body is substantially planar and can have a pair of slotted members extending from the front surface. The body of the tag can be connected directly to the hook or it can be connected to the hook by a neck. Preferably, the tag is made from a hard plastic or nylon material. The label is inserted into the slotted members, which are adapted to receive the opposing side edges and secure the label in place. The label can contain information relating to the merchandise attached to the tag and can include indicia and/or a bar code. Alternatively, the label may be secured to the outside of the shrink tube with, for example, a pressure-sensitive glue.

The substantially flat pad has an adhesive side and a friction side. The adhesive side is adapted to secure the pad to the rear surface of the body. The friction side is formed from a material with a high coefficient of friction, such as a soft rubber, and is used to frictionally secure the tag to one of the legs of the eyeglasses.

The shrink tube has a side wall, a first end, a second end and an opening extending between the two ends. The shrink tube is made of a plastic material, preferably a transparent and biaxially oriented plastic material, which shrinks when exposed to a heat source. Such packaging materials are well known to those skilled in the art. Polyethylene is the preferred plastic material for construction of the shrink tube. However, other heat shrinkable plastic materials, including polypropylene and polyvinyl chloride, can also be used. The shrink tube has a generally cylindrical shape and a length that is substantially the same as the length of the body of the tag. In one embodiment, the side wall of the shrink tube has a substantially flat portion so that the end of the shrink tube has the shape of the letter "D." When the body of the tag is inserted in the shrink tube, the flat side wall portion corresponds to the front surface of the body. In another embodiment, the shrink tube has a substantially circular cross-section.

The tag assembly is attached to a pair of eyeglasses by inserting the label into the slotted members on the front surface of the body and contacting the adhesive side of the pad to the rear surface of the body. The body of the tag is then inserted into the shrink tube and one of the hinged legs of the eyeglasses is inserted in the shrink tube between the friction side of the pad and the side wall of the shrink tube. A heat source is then applied to the shrink tube to secure the hinged leg in the tag assembly. The heat shrinking of the shrink tube also serves to secure the label to the tag. If the label is to be applied to the outside of the shrink tube instead of in the slotted members, a pressure-sensitive glue or other suitable adhesive is used to secure the label in place.

Referring now to the drawings, FIG. 1 shows an exploded view of the tag assembly 10 that includes the tag 12 having a body 14 and a hook 16 connected by a necked in portion or neck 18. The body 14 has a front surface 20 and a rear surface 22, as well as a first end 24 and a second end 26. A pair of slotted members 28 extend from the front surface 20 with the slots 30 facing inwardly, towards one another. A label 32 with a bar code 34 can be inserted into the slots 30 of the slotted members 28. A pad 36 having an adhesive side 38 and a friction side 40 is attached to the tag 12 by contacting the adhesive side 38 with the rear surface 22 of the body 14.

The body 14 of the tag 12 is inserted into a shrink tube 42 having a side wall 44 and an opening 46 extending between a first end 48 and a second end 50. In the preferred embodiment of the tag assembly 10 shown in FIG. 1, the shrink tube 42 has a flat portion 52 that corresponds to the front surface 20 of the body 14 of the tag 12. The remaining portion of the side wall 44 is curved. After the body 14 passes into the opening 46 in the shrink tube 42, there is sufficient space between the friction side 40 of the pad 36 and the side wall 44 of the shrink tube 42 (see FIGS. 2-4) to allow the hinged leg 96 to pass through the opening 46 (see FIGS. 13-16).

Figure 2:
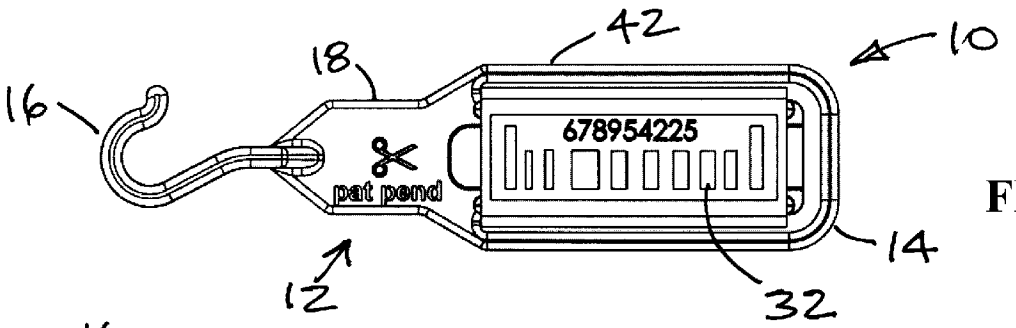
FIG. 2 is a plan view of the assembled shrink-wrap eyeglasses tag in FIG. 1.
Figure 3:
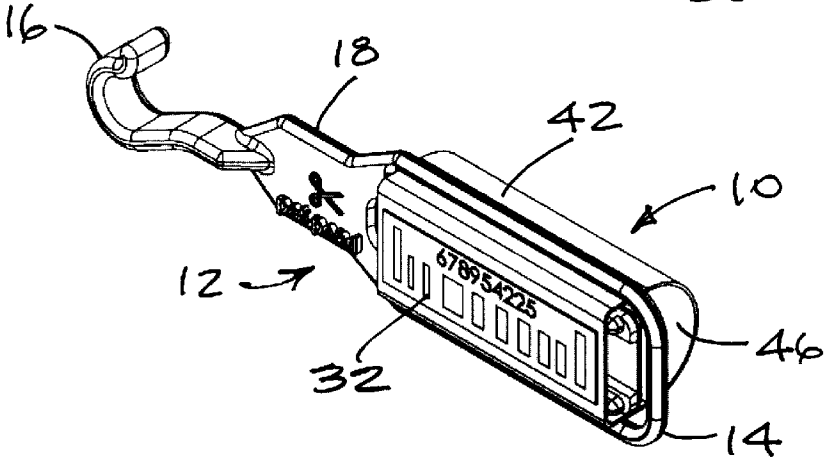
FIG. 3 is a perspective view of the assembled shrink-wrap eyeglasses tag in FIG. 1.
Figure 4:
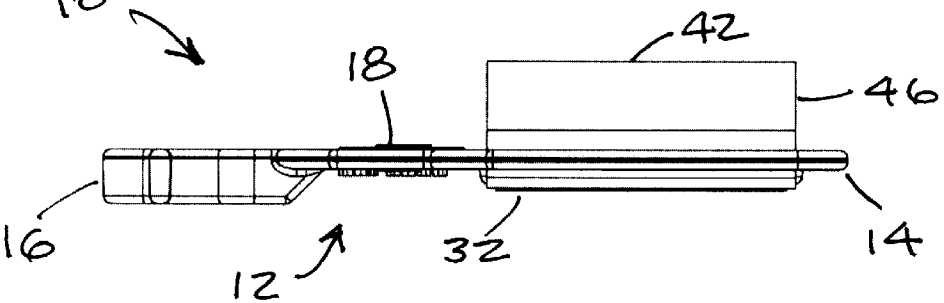
FIG. 4 is a side view of the assembled shrink-wrap eyeglasses tag in FIG. 1.

FIGS. 2-4 show different views of the assembled shrink wrapped eyeglasses tag with hook assembly 10. FIG. 2 is a plan view and shows the label 32 affixed to the front surface 20 of the body 14. FIG. 3 is a perspective view of the tag assembly 10 and shows that, after the body 14 is inserted in the shrink tube 42, the opening 46 provides sufficient space for inserting the hinged leg 96 (see FIGS. 13-16). FIG. 4 is a side view of the tag assembly 10 and shows how the shrink tube 42 extends away from the body 14 of the tag 12 before heat is applied to shrink the shrink tube 42 around the hinged leg 96 of the eyeglasses 90 (see FIGS. 13-16).

Figure 5:
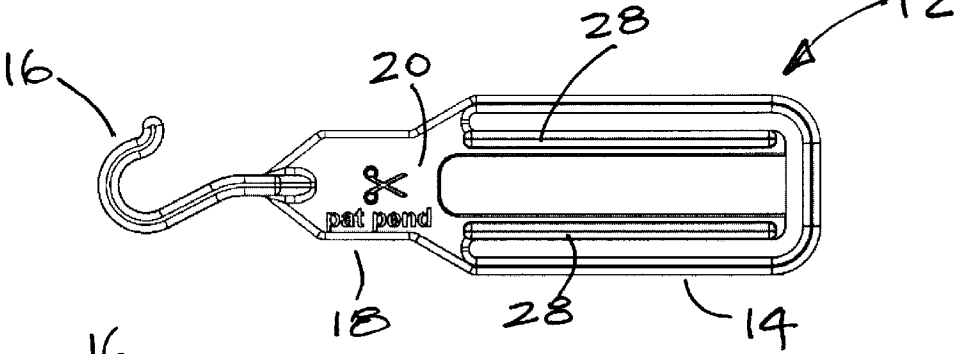
FIG. 5 is a plan view of the body and hook of the shrink-wrap eyeglasses tag in FIG. 1.
Figure 6:
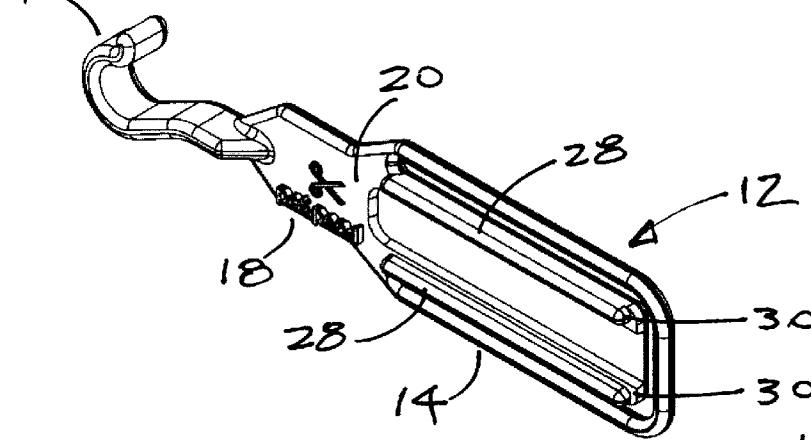
FIG. 6 is a perspective view of the body and hook of the shrink-wrap eyeglasses tag in FIG. 1.
Figure 7:
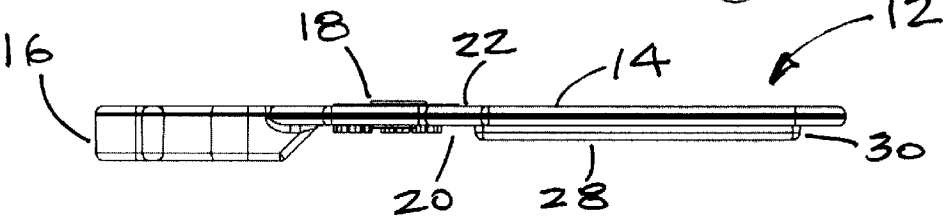
FIG. 7 is a side view of the body and hook of the shrink-wrap eyeglasses tag in FIG. 1.

FIGS. 5-7 show a plan, perspective and side view, respectively, of the tag 12. These figures show how the slotted members 28 extend from the front surface 20 of the body 14 and the slots 30 are formed on the inner sides of the slotted members 28. The slots 30 are designed to slidably receive the side edges 33, 35 of a label 32 (see FIG. 12) therebetween.

Figure 9:
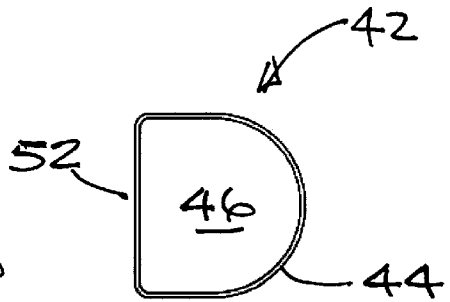
FIG. 9 is an end view of the shrink tube of the shrink-wrap eyeglasses tag in FIG. 1.
Figure 8:
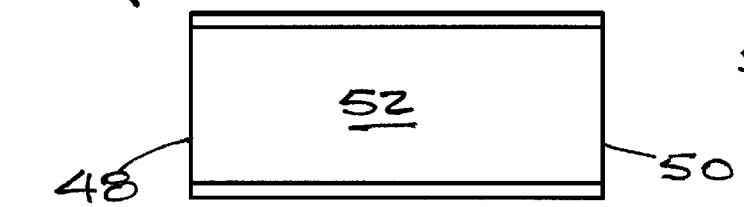
FIG. 8 is a front view of the shrink tube of the shrink-wrap eyeglasses tag in FIG. 1.

FIGS. 8 and 9 show a plan view and an end view, respectively, of the shrink tube 42. The figures show an embodiment wherein the side wall 44 on the front surface 52 of the shrink tube 42 is substantially flat. The end view in FIG. 9 illustrates the shrink tube 42. The shape of the shrink tube 42 can vary to accommodate the dimensions of the tag 12. The application of heat collapses the side wall 44 of the shrink tube 42 and secures any articles inserted in the opening 42.

Figure 11:
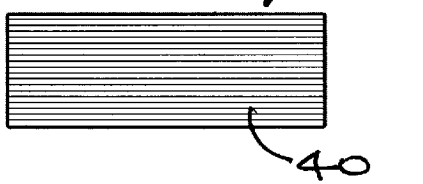
FIG. 11 is a back side view of the friction side of the pad of the shrink-wrap eyeglasses tag in FIG. 1.
Figure 10:
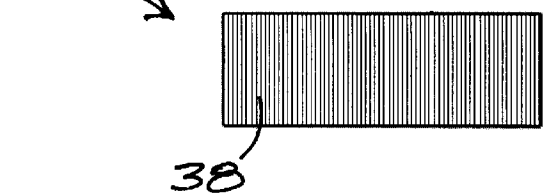
FIG. 10 is a front side view of the adhesive side of the pad of the shrink-wrap eyeglasses tag in FIG. 1.

FIGS. 10 and 11 show the opposing sides 38, 40 of the pad 36. The adhesive side 38 is used to attach the pad 36 to the rear surface 22 of the body 14 of the tag 12. The frictional side 40 of the pad 36 grips the hinged leg 96 of the eyeglasses 90 after the shrink tube 42 is shrunk and forces the hinged leg 96 against the pad 36.

Figure 12:
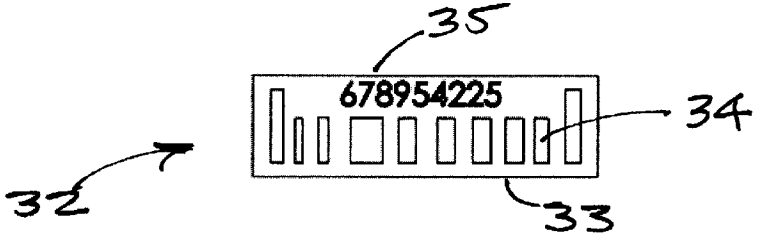
FIG. 12 is a front side view of the label of the shrink-wrap eyeglasses tag in FIG. 1.
Figures 13, 14, 15, 16:
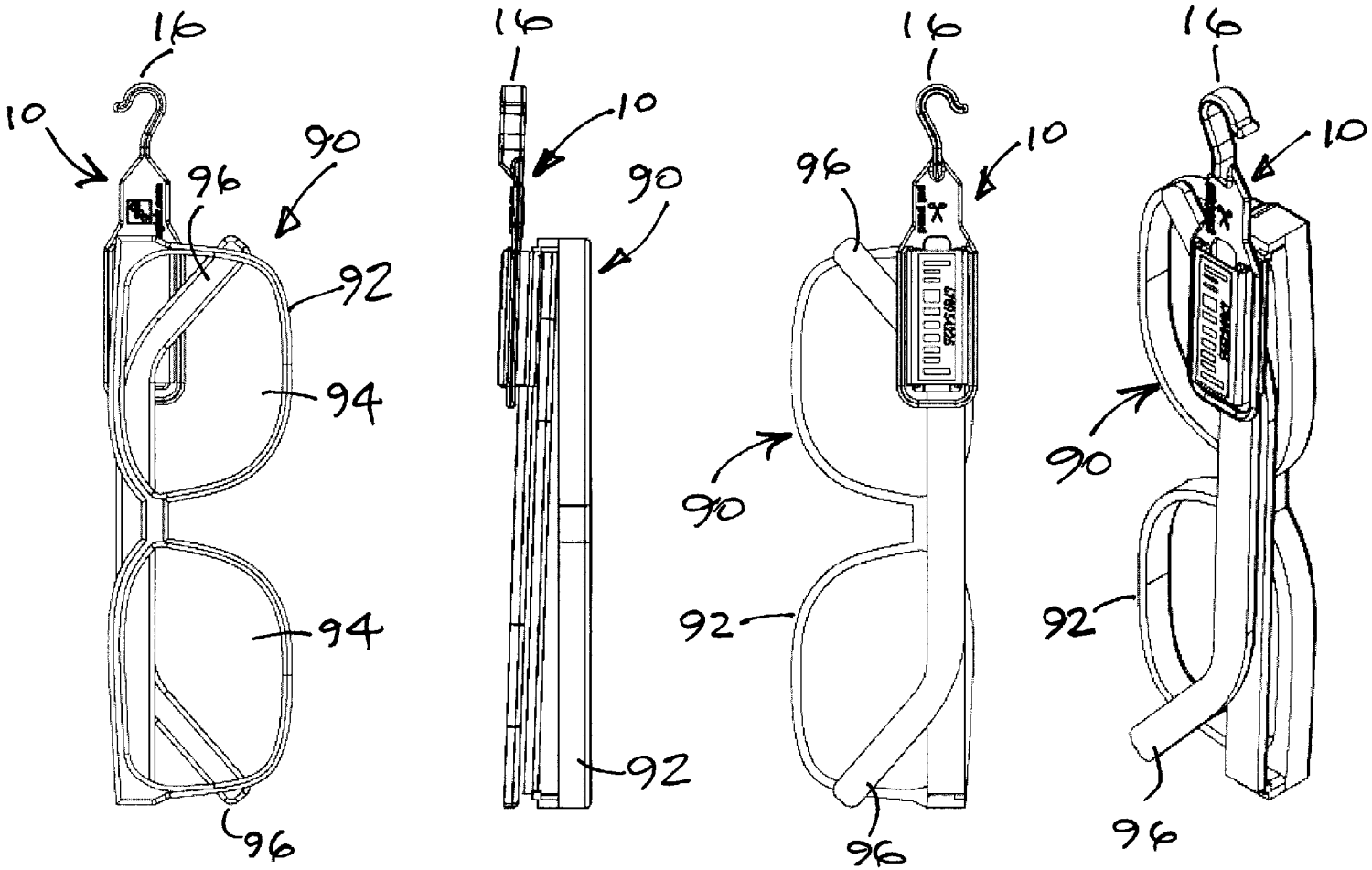
FIG. 13 is a front view of a pair of eyeglasses secured to the shrink-wrap eyeglasses tag in FIG. 1.
FIG. 14 is a side view of a pair of eyeglasses secured to the shrink-wrap eyeglasses tag in FIG. 1.
FIG. 15 is a rear view of a pair of eyeglasses secured to the shrink-wrap eyeglasses tag in FIG. 1.
FIG. 16 is a perspective view of a pair of eyeglasses secured to the shrink-wrap eyeglasses tag in FIG. 1.

FIG. 12 shows the label 32 with indicia and a bar code 34 contained thereon for identifying the article attached to the tag assembly 10 (see FIGS. 13-16). The opposing side edges 33, 35 of the label 32 are inserted into the slots 30 of the slotted members 28.

FIGS. 13-16 show a rear, side, front and perspective view of the tag assembly 10 attached to a pair of eyeglasses 90. The eyeglasses 90 include a frame 92 that encloses a pair of lenses 94 and a pair of hinged legs 96. One of the hinged legs 96 is inserted into the opening 46 in the shrink tube 42. Heat is then applied to the shrink tube 42 to snugly shrink the shrink tube 42 around the tag 12 and the hinged leg 96. The hook 16 of the tag assembly 10 can then be used to hang the tag assembly 10 and eyeglasses 90 in a display.

Figure 17:
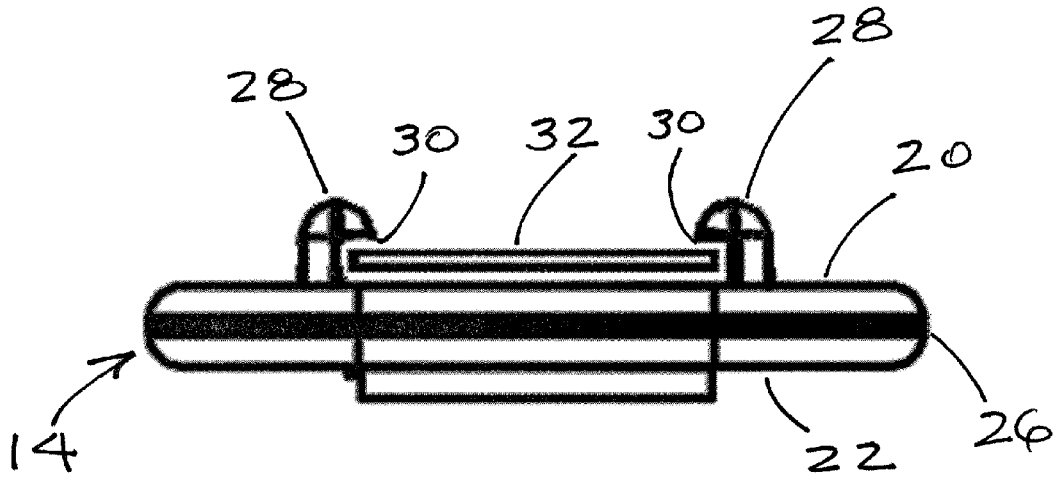
FIG. 17 is an end view of the second end of the body of the shrink-wrap eyeglasses tag in FIG. 1.

FIG. 17 shows an end view of the second end 26 of the body 14 of the tag 12. A pair of slotted members 28 extends upwardly and inwardly from the front surface 20 of the body 14 to form a pair of slots 30 that face inwardly, towards one another. A label 32 can be inserted into the slots 30 of the slotted members 28.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A tag assembly for securing a tag to a pair of eyeglasses having a frame, a first hinged leg and a second hinged leg, the tag assembly comprising:

a tag comprising a body having a first end, a second end, a front surface and a rear surface;

a pair of slotted members extending from the front surface of the body and perpendicular to the ends, wherein each of the slotted members has a slot having opposing open ends and four sides, wherein one side is an open side adjacent to a side formed by the front surface of the body of the tag and the other two sides are formed by the slotted member, and wherein the open sides of the slots face each other; and a shrink tube having a side wall, a first end, a second end and an opening extending therebetween, wherein the body of the tag is inserted into the shrink tube and one of the hinged legs of the pair of eyeglasses is inserted between the rear surface of the body of the tag and the shrink tube and wherein the shrink tube secures the hinged leg in the tag assembly upon the application of heat.

2. The tag assembly according to claim 1, wherein the tag further comprises a hook, and wherein the hook extends arcuately from the first end of the body to a distal end.

3. The tag assembly according to claim 2, wherein the body of the tag is connected to the hook by a neck.

4. The tag assembly according to claim 1, further comprising a planar label extending lengthwise between opposing ends and having opposing side edges, wherein the slots in the slotted members are adapted to slidably receive the opposing side edges.

5. The tag assembly according to claim 1, further comprising a substantially flat pad having an adhesive side and a friction side, wherein the adhesive side is adapted to secure the pad to the rear surface of the body.

6. The tag assembly according to claim 5, wherein the adhesive side of the pad is placed in contact with the rear surface of the body and the friction side of the pad contacts the first hinged leg.

7. The tag assembly according to claim 5, wherein the friction side of the pad is formed from a material having a high coefficient of friction.

8. The tag assembly according to claim 5, wherein the friction side of the pad is formed from a soft rubber material.

9. The tag assembly according to claim 1, wherein the tag is made from a hard plastic or nylon material.

10. The tag assembly according to claim 1, wherein a label is secured to the outside of the shrink tube.

11. The tag assembly according to claim 10, wherein the label is secured to the outside of the shrink tube with a pressure-sensitive glue.

12. The tag assembly according to claim 1, wherein the shrink tube is made from a plastic material.

13. The tag assembly according to claim 1, wherein the shrink tube is made from a transparent and biaxially oriented plastic material.

14. The tag assembly according to claim 1, wherein the shrink tube is made from polyethylene, polypropylene or polyvinyl chloride.

15. The tag assembly according to claim 1, further comprising a label containing information, indicia and/or a bar code relating to the pair of eyeglasses attached to the tag.

16. A tag assembly for securing a tag to a pair of eyeglasses having a frame, a first hinged leg and a second hinged leg, the tag assembly comprising:

a tag comprising a body having a first end, a second end, a front surface and a rear surface;

a pair of slotted members extending from the front surface of the body and perpendicular to the ends, wherein each of the slotted members has a slot having opposing open ends and four sides, wherein one side is an open side adjacent to a side formed by the front surface of the body of the tag and the other two sides are formed by the slotted member, and wherein the open sides of the slots face each other;

a planar label extending lengthwise between opposing ends and having opposing side edges, wherein the slots in the slotted members are adapted to slidably receive the opposing side edges;

a substantially flat pad having an adhesive side and a friction side, wherein the adhesive side is adapted to secure the pad to the rear surface of the body; and a shrink tube having a side wall, a first end, a second end and an opening extending therebetween, wherein the label is inserted into the slotted members of the body, the adhesive side of the pad is placed in contact with the rear surface of the body and the body of the tag is inserted into the shrink tube, wherein the tag assembly receives one of the hinged legs of the pair of eyeglasses between the friction side of the pad and the shrink tube and wherein the shrink tube secures the hinged leg in the tag assembly upon the application of heat.

17. The tag assembly according to claim 16, wherein the tag further comprises a hook, and wherein the hook extends arcuately from the first end of the body to a distal end.

18. The tag assembly according to claim 16, wherein the tag is made from a hard plastic or nylon material and the friction side of the pad is formed from a soft rubber material.

19. The tag assembly according to claim 16, wherein the shrink tube is made from a transparent and biaxially oriented plastic material.

20. A tag assembly for securing a tag to a pair of eyeglasses having a frame, a first hinged leg and a second hinged leg, the tag assembly comprising:

a tag comprising a body and a hook, wherein the body is made from a hard plastic or nylon material and has a first end, a second end, a front surface and a rear surface, and wherein the hook extends from the first end of the body;

a pair of slotted members extending from the front surface of the body and perpendicular to the ends, wherein each of the slotted members has a slot having opposing open ends and four sides, wherein one side is an open side adjacent to a side formed by the front surface of the body of the tag and the other two sides are formed by the slotted member, and wherein the open sides of the slots face each other;

a planar label extending lengthwise between opposing ends and having opposing side edges, wherein the slots in the slotted members are adapted to slidably receive the opposing side edges;

a substantially flat pad having an adhesive side and a friction side, wherein the adhesive side is adapted to secure the pad to the rear surface of the body and wherein the friction side of the pad is formed from a soft rubber material; and a shrink tube having a side wall, a first end, a second end and an opening extending therebetween, wherein the shrink tube is made from a transparent and biaxially oriented plastic material, wherein the label is inserted into the slotted members of the body, the adhesive side of the pad is placed in contact with the rear surface of the body and the body of the tag is inserted into the shrink tube, wherein the tag assembly receives one of the hinged legs of the pair of eyeglasses between the friction side of the pad and the shrink tube and wherein the shrink tube secures the hinged leg in the tag assembly upon the application of heat.

* * * * *